US010035159B2

(12) United States Patent
Bruder et al.

(10) Patent No.: US 10,035,159 B2
(45) Date of Patent: Jul. 31, 2018

(54) DISPENSER FOR FLUIDS

(71) Applicant: APTAR RADOLFZELL GMBH, Radolfzell (DE)

(72) Inventors: Thomas Bruder, Constance (DE); Tobias Baumann, Gottmadingen-Randegg (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 0 days.

(21) Appl. No.: 15/111,633

(22) PCT Filed: Nov. 27, 2014

(86) PCT No.: PCT/EP2014/075753

§ 371 (c)(1),
(2) Date: Jul. 14, 2016

(87) PCT Pub. No.: WO2015/106868

PCT Pub. Date: Jul. 23, 2015

(65) Prior Publication Data

US 2016/0332180 A1 Nov. 17, 2016

(30) Foreign Application Priority Data

Jan. 17, 2014 (DE) ..... 10 2014 200 867

(51) Int. Cl.
*B05B 11/00* (2006.01)

(52) U.S. Cl.
CPC ..... *B05B 11/3035* (2013.01); *B05B 11/3033* (2013.01); *B05B 11/3036* (2013.01); *B05B 11/3053* (2013.01); *B05B 11/3028* (2013.01)

(58) Field of Classification Search
CPC ..... B05B 11/3035; B05B 11/3033; B05B 11/3028; B05B 11/3036; B05B 11/3053;
(Continued)

(56) References Cited

U.S. PATENT DOCUMENTS 4,088,248 A * 5/1978 Blake ..... B05B 11/3028 222/207
4,201,317 A * 5/1980 Aleff ..... B05B 11/0016 137/855

(Continued)

FOREIGN PATENT DOCUMENTS

DE 39 09 633 A1 10/1990
DE 20 2008 011 730 U1 11/2009

(Continued)

OTHER PUBLICATIONS

International Search Report issued in Application No. PCT/EP2014/075753 with English translation dated Mar. 17, 2015 (7 pages).

(Continued)

*Primary Examiner* — Charles P Cheyney
(74) *Attorney, Agent, or Firm* — Flynn, Thiel, Boutell & Tanis, P.C.

(57) ABSTRACT

Fluid dispenser for the discharge of pharmaceutical or cosmetic fluids including a fluid reservoir in which fluid is stored prior to discharge, an outlet channel through which the fluid is dispensed to an environment, and a pump chamber which, starting from an initial state with maximum pump chamber volume, is volumetrically reduced by a manual pump activation. An inlet valve arrangement is provided between the fluid reservoir and the pump chamber, which opens in a pressure regulated manner when a negative pressure exists in the pump chamber with respect to the fluid reservoir, and an outlet valve arrangement is provided between the pump chamber and the discharge opening. The outlet valve arrangement includes a switching valve mechanically compelled to open in reaction to a displacement of an activation handle and independent of the fluid pressure in the pump chamber.

11 Claims, 6 Drawing Sheets

(58) Field of Classification Search
CPC ..... B05B 11/0048; B05B 11/3076; B05B 11/3097
USPC ..... 222/207, 321.7, 341, 494, 321.9, 394, 222/386
See application file for complete search history.

(56) References Cited

U.S. PATENT DOCUMENTS 5,238,156 A * 8/1993 Andris ..... B05B 11/007 222/207
6,406,207 B1 * 6/2002 Wiegner ..... A46B 11/0027 222/207
6,755,327 B1 * 6/2004 Hazard ..... B05B 11/3035 222/209
8,240,516 B2 * 8/2012 Lautre ..... B05B 11/0029 222/153.13
9,205,439 B2 12/2015 Goettke et al.
2005/0189377 A1 9/2005 Lanzendorfer et al.
2008/0110934 A1 * 5/2008 Behar ..... B05B 11/3033 222/207
2014/0061243 A1 3/2014 Goettke et al.

FOREIGN PATENT DOCUMENTS

DE 10 2011 001 512 A1 9/2012
WO WO 2004/004921 A1 1/2004
WO WO 2012/074315 A2 6/2012
WO WO 2012/165727 A1 12/2012

OTHER PUBLICATIONS

Written Opinion of International Searching Authority issued in Application No. PCT/EP2014/075753 dated Mar. 17, 2015 (6 pages).
Search/Examination Report issued in German Priority Application No. 10 2014 200 867.0 dated Sep. 30, 2014 (4 pages).

* cited by examiner

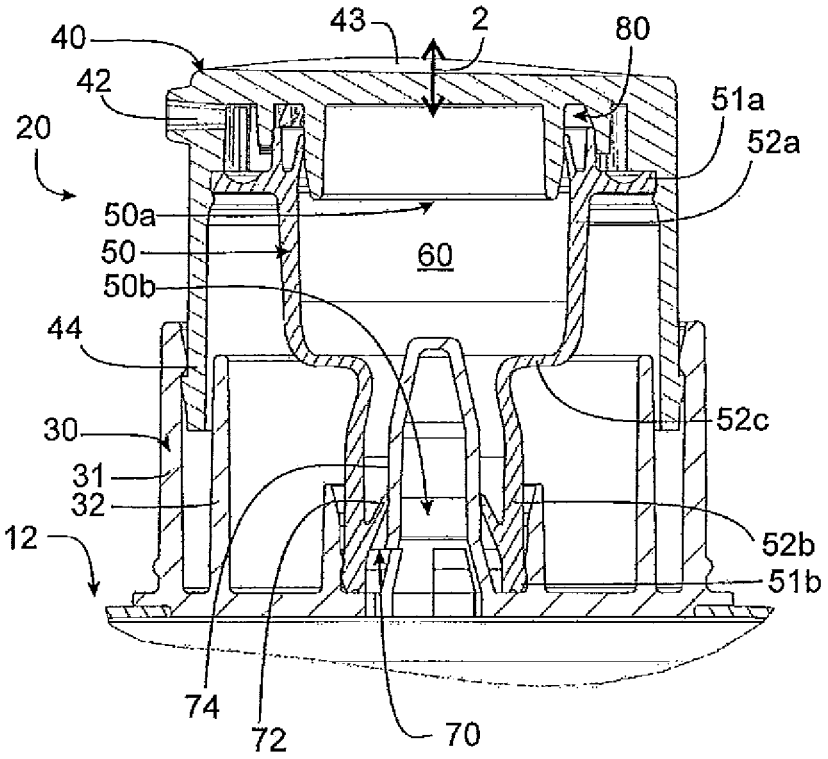
*Fig. 1a*
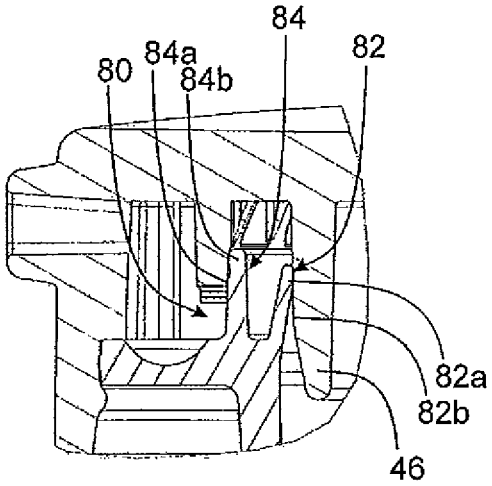

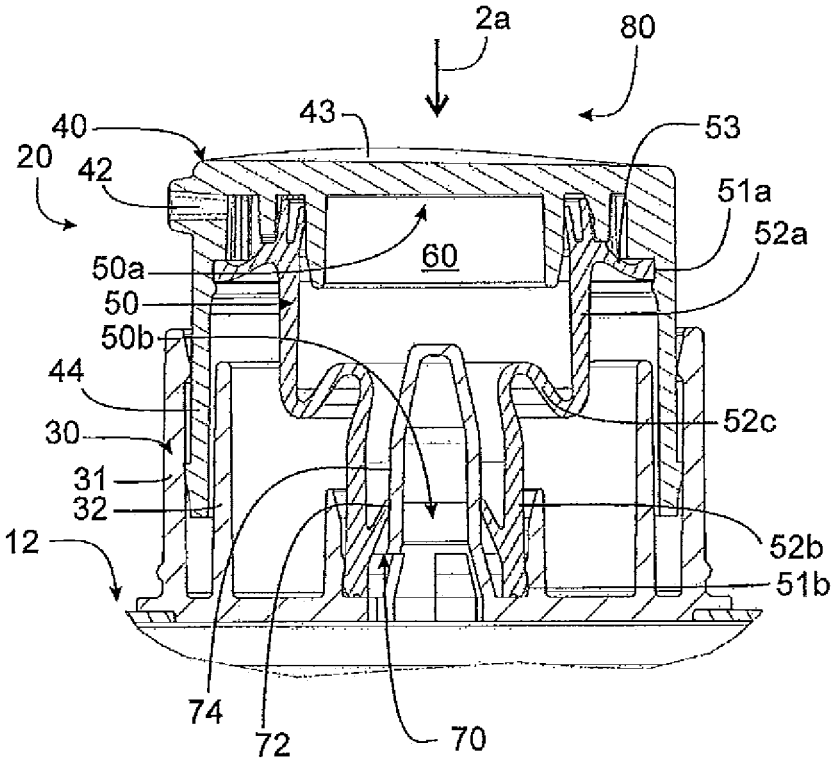
*Fig. 1b*
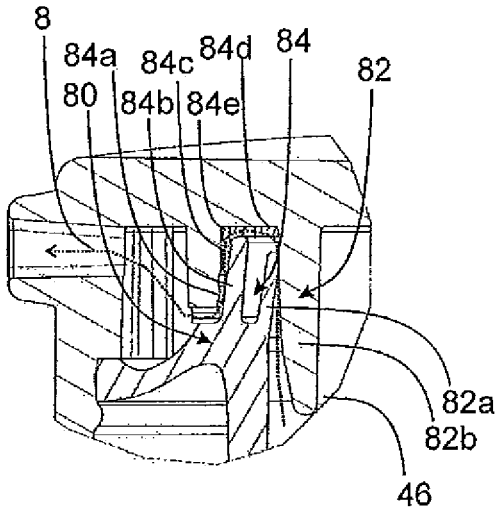

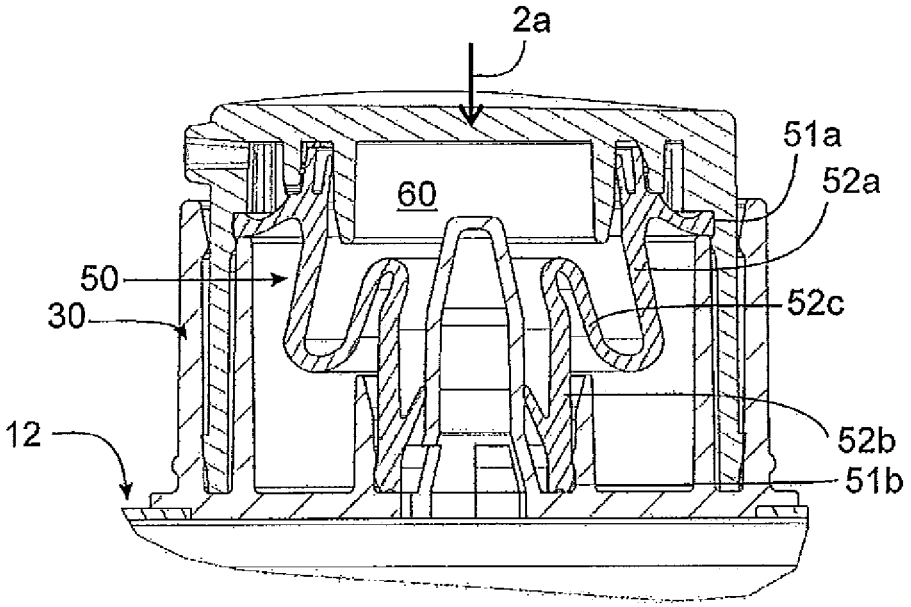
*Fig. 1c*
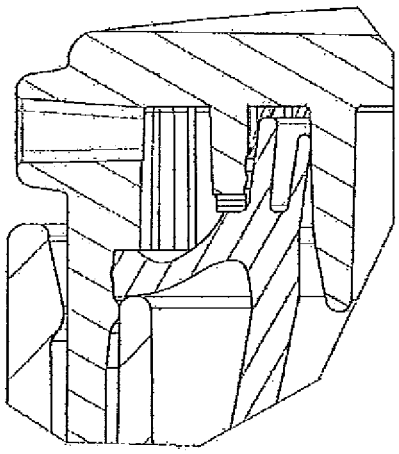

DISPENSER FOR FLUIDS

FIELD OF APPLICATION, AND PRIOR ART

The invention relates to a liquids dispenser for discharging pharmaceutical or cosmetic liquids, or liquids of the foodstuffs sector. A liquids dispenser of the generic type is equipped with a liquids reservoir in which the liquid is stored prior to discharging, with an outlet duct through which the liquid may be dispensed to an environment, and with a pump chamber which, proceeding from an initial state having the maximum pump chamber capacity, is volumetrically reducible by manual actuation of the pump by means of an actuation handle. Here, in the case of a liquids dispenser of the generic type an inlet valve assembly is provided between the liquids reservoir and the pump chamber, which inlet valve assembly is opened in a pressure-controlled manner when there is negative pressure in the pump chamber in relation to the liquids reservoir. Furthermore, an outlet valve assembly is provided between the pump chamber and the discharge opening.

A multiplicity of dispensers of the generic type are known from the prior art. Said dispensers dispose of a pump which comprises the pump chamber, the inlet valve assembly, and the outlet valve assembly, and which permits liquid to be dispensed by means of an actuation handle which is to be manually actuated. Apart from low-viscosity liquid media, a liquid in the context of this invention is also understood to include pasty media.

The liquids dispensers of the generic type on which the invention is based are mobile liquids dispensers which have a liquids reservoir of usually less than 200 ml and which are mostly conceived as single-use dispensers and sold together with the liquid which is intended to be discharged by the former.

The pump installations of known dispensers of the generic type usually dispose of inlet and outlet valve assemblies which each are operated in a pressure-controlled manner. Positive pressure in the liquids reservoir in relation to the pump chamber leads to the inlet valve assembly being opened such that the liquid can flow into the pump chamber. Positive pressure in the pump chamber in relation to an atmosphere surrounding the dispenser leads to the outlet valve assembly being opened such that liquid may be discharged. The pump chamber is reduced in size when the actuation handle is actuated, on account of which the inlet valve assembly is closed and the outlet valve assembly is opened in the case of the type of dispensers mentioned. During the subsequent increase in size of the pump chamber in the course of a return stroke movement and of the negative pressure created on account thereof, the inlet valve assembly is opened and the outlet valve assembly is closed. Liquid is suctioned from the liquids reservoir into the pump chamber in readiness for the next discharging procedure.

It is viewed as problematic in the known liquids dispensers of the generic type that the latter in the case of certain designs or under certain circumstances tend to leak. This applies, for example, when the liquids dispenser has a tube as a liquids reservoir. If and when the tube is inadvertently compressed, this may cause simultaneous opening of both the inlet valve assembly and the outlet valve assembly such that the liquid inadvertently escapes from the liquids reservoir. Also, the low ambient pressure which arises during air transportation of such a liquids dispenser may have the effect that the outlet valve assembly and in some cases also the inlet valve assembly is/are opened. Liquid may also inadvertently escape in such a situation.

OBJECT AND ACHIEVEMENT

It is an object of the invention to refine a liquids dispenser of the generic type with a view to the latter having improved protection against leakage. This is achieved according to the invention in that the outlet valve assembly comprises a switch valve which, independently of the liquid pressure in the pump chamber, as a reaction to the actuation handle being displaced is forcibly opened in a mechanical manner.

As opposed to the liquids dispensers outlined at the outset, it is thus provided in a liquids dispenser according to the invention that the opening of the outlet valve assembly is performed in the manner of a forcible opening, the latter to be understood to mean that the displacement of the actuation handle causes the outlet valve assembly to be opened, regardless of the pressure prevailing in the pump chamber. Actuating the actuation handle thus fulfills a dual function, specifically the mentioned volumetric reduction of the pump chamber, on the one hand, and the forcible opening of the outlet valve assembly in a pressure-independent manner, by opening the switch valve, on the other hand.

In principle, the outlet valve assembly in the case of a liquids dispenser according to the invention may be designed such that the former is opened solely by positive pressure of the liquid in the pump chamber, even when the actuation handle is not actuated. However, it is of advantage if such opening of the outlet valve assembly by way of positive pressure in the pump chamber alone does not take place, at least up to a limit value of positive pressure. Consequently, the outlet valve assembly is preferably configured in such a manner that the latter in the case of the actuation handle not being actuated prevents opening, wherein preferably opening is prevented in relation to the outlet duct/to the environment at least up to a positive pressure of 700 mbar in the pump chamber, preferably up to a positive pressure of at least 1500 mbar.

Such an outlet valve assembly which may not be opened by positive pressure in the pump chamber alone, or only once a significant positive pressure has been reached, prevents an inadvertent discharging procedure from being initiated when there is positive pressure in the pump chamber in relation to an environment by virtue of other means than by manual actuation. Having a safety feature preventing purely pressure-actuated opening of the outlet valve assembly up to a positive pressure of 700 mbar enables in particular also air transportation of liquids dispensers without the risk of leakage. It is particularly advantageous for the switch valve to be configured such that the latter is urged in the direction of the closed position thereof by positive pressure in the pump chamber such that inadvertent pressure-dependent opening cannot arise without the dispenser being destroyed.

One particularly preferred design embodiment of the switch valve of the outlet valve assembly provides that this switch valve has a first sealing face which is forcibly coupled, in particular integrally connected, to the actuation handle, and a second sealing face which is movable in relation to the first sealing face and in the closed state of the outlet valve assembly bears on the first sealing face. Here, the second sealing face is movable in relation to the first sealing face and, by displacing the actuation handle, said second sealing face may be traversed onto an opening region which is contiguous to the first sealing face and which is configured such that said opening region prevents the first sealing face bearing on the second sealing face in a tight manner.

According to this proposal, the switch valve is thus configured as a type of gate valve. By displacing the actuation handle and the first sealing face which is connected thereto at least in an indirect manner but preferably in a direct manner, the second sealing face is traversed on the first sealing face until in the opening region which is contiguous to the first sealing face said second sealing face at least in portions is forcibly released from the first sealing face in such a manner that liquid may flow through between the first sealing face and the second sealing face.

One particularly advantageous design embodiment thereof provides that in the opening region which is contiguous to the first sealing face, a ramp-type web or a plurality of ramp-type webs which are mutually spaced apart is/are provided, the second sealing face being pushed onto the latter such that a separation of the two sealing faces is performed on either side of this web. This ramp-type web is preferably provided with one or a plurality of interruption points at which a separation of the second sealing face from the bearing area on the opening region is enforced.

It is viewed as particularly advantageous for the component on which the first sealing face is provided, and the component on which the second sealing face is provided, to be interconnected by a sprung element which is tensioned when the second sealing face is transferred into the opening region.

It is achieved on account thereof that opening of the switch valve by displacing the actuation handle simultaneously leads to tension in the sprung element mentioned. When the actuation handle is returned to the basic position thereof, the switch valve is thus automatically closed again by the sprung element mentioned. The sprung element may be a separate sprung element such as a helical spring, for example. However, the sprung element is preferably an elastic portion capable of forming, which is configured integrally with the second sealing face and which is supported on that component on which the first sealing face is provided, in particular on the actuation handle. The sprung element may in particular be configured as an encircling deformable web on the external side of a pump chamber wall body.

In the case of one preferred design embodiment the outlet valve assembly, apart from the switch valve which is provided according to the invention, also has a separate pressure relief valve which is opened in a pressure-controlled manner when there is positive pressure in the pump chamber in relation to the outlet duct.

In the case of such a design the outlet valve assembly thus disposes of two separate valves which are provided sequentially in series between the pump chamber and the discharge opening. In order for a discharging procedure to be initiated, both the switch valve and the pressure relief valve have to be opened.

This design having a separate pressure relief valve is above all advantageous since this pressure relief valve in the course of the return stroke of the actuation handle, after a discharging procedure having been performed, closes immediately when the pump chamber capacity increases again. The suction process into the pump chamber which takes place during the return stroke is thus not delayed by the switch valve not immediately being closed.

In the sense of a simple design embodiment of the liquids dispenser with as few components as possible it is of advantage for at least the second sealing face of the switch valve and at least one sealing face of the pressure relief valve to be integrally configured; a common and preferably elastically deformable component which makes available sealing faces of both separate valves is thus provided.

With a view to further simplification of the construction it is viewed as advantageous for the pump chamber to have a flexible wall which enables volumetric variability of the latter. This wall surrounds the pump chamber. This is preferably a component which is substantially rotationally symmetrical and is open at both ends. The mentioned second sealing face of the switch valve, and/or the mentioned sealing face of the pressure relief valve, in an advantageous design may be configured so as to be integral with this wall.

A particularly advantageous design of the liquids dispenser in which the entire outlet valve assembly, comprising the switch valve and the pressure relief valve, is collectively formed by that component that also forms the wall of the pump chamber, on the one hand, and by the actuation handle, on the other hand, may thus be achieved.

That component forming the wall of the pump chamber may simultaneously also act as a return spring of the liquids dispenser. It is of advantage in particular for this purpose for the pump chamber wall to be configured so as to be closed in an encircling manner and to have at one first end a substantially cylindrical first portion of an external diameter which is smaller than the internal diameter of a substantially cylindrical second portion at an opposite second end, wherein the pump chamber wall in the actuated state of the actuation handle is deformed in such a manner that the first portion is surrounded by the second portion.

Such a pump chamber wall in the case of the actuation handle not being actuated has the approximated shape of a chalice. By displacing the actuation handle the second end, which in terms of the diameter is larger, is pushed over the first end, overlapping the latter in relation to the direction of compression of the pump chamber wall. A connection region which connects the cylindrical portions of dissimilar diameters, for the purpose of the return function preferably acts as an elastically deformable sprung element. This connection region is preferably configured having thinner walls than the cylindrical regions.

One advantageous design of a liquids dispenser according to the invention provides that the actuation handle is operationally coupled to the pump chamber and to the switch valve in such a manner that in the case of the actuation handle being actuated, the switch valve is initially opened and the pump chamber is subsequently reduced in size.

In the case of such a design it is thus provided that there is initially no interaction between the displacement of the actuation handle and the pump chamber capacity, since only the switch valve is initially opened in the course of the commencing displacement of the actuation handle. It is only when the switch valve is opened that delayed operational coupling between the actuation of the actuation handle and the pump chamber capacity arises.

One possibility in terms of construction in order for this to be designed lies in that an opening portion which is displaceable by the actuation handle and which in particular is preferably an integral part of the actuation handle and which has two active faces is provided, wherein a first active face of the two active faces is provided for impinging a first counter face on a valve body or on a valve flap with a force, and wherein furthermore the second active face of the two active faces is provided for impinging a second counter face with a force, wherein the pump chamber is reducible in size by impinging the second counter face with a force. Here, in an initial state of the liquids dispenser, in which the actuation handle is not actuated, the spacing between the first active face and the first counter face is smaller than the spacing between the second active face and the second counter face.

In the case of the actuation handle being actuated, the first active face and the first counter face thus initially come into contact with one another such that, on account thereof, the valve is subsequently opened. It is only in the case of continued displacement of the actuation handle that the second active face and the second counter face come into contact, the reduction in size of the pump chamber taking place thereafter.

In the case of such a design, the first active face which is provided for opening the switch valve by displacing the valve body or the valve flap, may fulfill yet another function. Said first active face, in the case of a non-actuated actuation handle, is disposed in such a manner that the former, acting as a stop, prevents displacement of the valve body or of the valve flap, which is conceived by high pressure in the pump chamber, counter to the intended opening direction such that, on account thereof, opening of the outlet valve assembly by virtue of the pressure of the liquid in the pump chamber alone is prevented, at least up to a certain limit value of pressure.

One further advantageous design embodiment of a liquids dispenser according to the invention provides that the pump chamber at least in portions is delimited by an elastically deformable wall. Sealing faces of the switch valve, which in the closed state are mutually bearing, are provided on or fastened to this wall in such a manner that by deformation of the wall as a consequence of the actuation handle being displaced they are mutually spaced apart such that the switch valve is opened.

It is thus provided in this design that forcible opening of the switch valve in a mechanical manner is performed when the pump chamber wall is deformed. This opening by virtue of the spacing apart of the sealing faces of the switch valve here is performed regardless of any potentially existing liquid pressure in the pump chamber, by virtue of the deformation of the wall of the pump chamber alone. This may be achieved in a particularly advantageous manner by a pump chamber wall which has a bell shape, that is to say which from a maximum diameter tapers off in the direction of the switch valve, it being particularly advantageous for the sealing faces to be an immediate part of this wall. The desired effect of the valve, which is preferably configured in the manner of a slot valve, being forcibly opened in a mechanical manner by the deformation of the wall may be achieved in particular by a comparatively thick-walled design of the wall.

BRIEF DESCRIPTION OF THE DRAWINGS

Further aspects and advantages of the invention are derived from the claims and from the exemplary embodiments which will be explained hereunder by means of figures in which:

FIGS. 1*a* to 1*c* show a first exemplary embodiment of a dispenser according to the invention, in the non-actuated, the partially actuated, and the actuated state;

DETAILED DESCRIPTION OF THE EXEMPLARY EMBODIMENTS

Figure 2A:
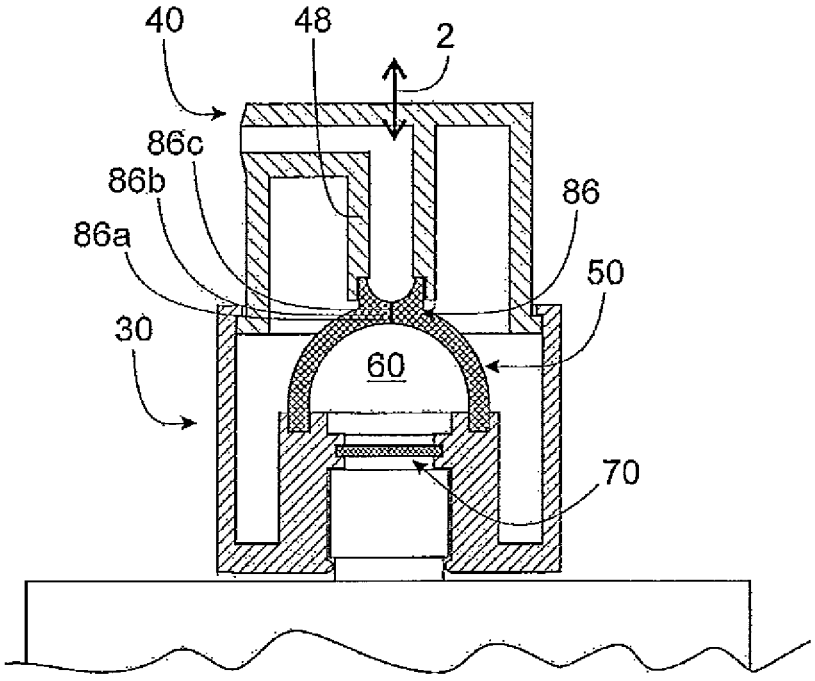
FIGS. 2*a* and 2*b* show a second exemplary embodiment of a dispenser according to the invention, in the actuated and the non-actuated state.

The three exemplary embodiments which will be described hereunder represent liquids dispensers which may have various kinds of liquids reservoirs. Since the design according to the invention is particularly advantageous in the case of liquids reservoirs which are configured as tubes, such tube-type liquids reservoirs are mentioned hereunder. However, this is to be understood as being exemplary.

All three dispensers which are described hereunder dispose of a discharge head which is fastened on top of this tube or on top of another liquids reservoir, and which disposes of a volumetrically variable pump chamber which by displacing an actuation handle may be reduced in size in relation to an assigned base, in order to discharge liquid. The description of the functional mode hereunder assumes a pump chamber which is not filled with liquid, since it is provided according to the invention that opening of the outlet valve of the pump chamber takes place regardless of any liquid pressure which arises upon actuation. Of course, the pump chamber during normal operation of such a dispenser is filled with liquid such that the latter may be discharged when the volume of the pump chamber is reduced.

FIGS. 1*a* to 1*c* show a first embodiment of a dispenser according to the invention. The liquids reservoir 12 of this dispenser, which in an exemplary manner is of the tube type, is only partially illustrated. The discharge head 20 of the dispenser is composed of only three components, specifically of a base 30, an actuation handle 40 having a discharge opening 42, and an interdisposed pump chamber component 50. A riser which extends into the liquids reservoir 12 and which is preferably provided in the case of dispensers according to the invention is not illustrated.

The actuation handle 40 comprises a pressure area 43 and a jacket face 44 which protrudes downward from the former. This jacket face 44, together with an internal encircling guide web 31 and an external encircling guide web 32, forms a guide on the sides of the base 30, along which guide the actuation handle 40 is displaceable in the direction of the arrow 2.

While the base 30 and the actuation handle 40 are composed of a comparatively rigid and, according to the intended use, non-deformable plastics material such as PP or PE, the pump chamber component 50 disposed therebetween is manufactured from an elastically deformable material such as, for example, an elastomeric material. The pump chamber component 50 has a shaping which is substantially rotationally symmetrical, and at the lower end 50*b* thereof and at the upper end 50*a* thereof is designed to be open. Retaining portions 51*a*, 51*b* by means of which the component 50 is fastened to the base 30, on the one hand, and to the actuation handle 40, on the other hand, are provided at both ends 50*a* and 50*b*. Therefore, the pump chamber component 50 is compressed when the actuation handle 40 is depressed in the direction of the arrow 2. The component 50 has a chalice-type shape which disposes of two approximately cylindrical regions 52*a*, 52*b*, and a connection region 52*c* therebetween. The wall thickness of the component in the connection region 52*c* is reduced in relation to the mean wall thickness into the cylindrical regions 52*a*, 52*b*. The connection region 52*c*, in particular, during operation acts as a spring, as will yet be explained hereunder.

The pump chamber component 50 surrounds a pump chamber 60 of the dispenser, which according to the intended use is volumetrically reduced in order for liquid to be discharged. In order for the discharging procedure to be enabled, an inlet valve assembly 70 and an outlet valve assembly 80 which are disposed on the entry side or the exit side, respectively, of the pump chamber 60 are provided.

The inlet valve assembly 70 disposes of an inlet valve which is formed by a valve lip 72 and a counter face 74 which is provided on a centric pin. This inlet valve is opened depending on the pressure differential between the pump chamber 60 and the liquids reservoir 12. If there is negative pressure in the pump chamber 60 in the course of the return stroke, the inlet valve is opened, permitting the inflow of liquid into the pump chamber 60. For the purpose of simplified construction, the valve lip 72 is designed to be integral with the pump chamber component 50.

The outlet valve assembly 80 is of more complex construction and, therefore, is illustrated once more in an enlarged manner in FIG. 1*a*. Said outlet valve assembly 80 comprises an outlet valve 82 which is likewise opened in a pressure-dependent manner, having a sealing lip 82*a* and a counter face 82*b* which is provided on a collar-type web 46 which is provided so as to be integral on the actuation handle 40. A switch valve 84 is additionally part of the outlet valve assembly. This switch valve 84 disposes of a valve lip 84*a* which, like the valve lip 82*a*, is provided so as to be integral on the pump chamber component 50. Said switch valve 84 furthermore disposes of a cylindrical counter face 84*b* which is disposed so as to be external to the valve lip 84*a* and is an integral part of the actuation handle 40.

This switch valve 84 in the non-actuated state of the dispenser is closed. The sealing lip 84*b* in an encircling manner bears from the inside on the counter face 84*a*. The switch valve 84 cannot be opened even by increasing the pressure in the pump chamber 60, since any such increased pressure, achieved for example by squeezing the tube 12, may indeed open the inlet valve assembly 70 and the pressure relief valve 82, but the pressure further increases the sealing effect on the switch valve 84 rather than likewise opening the latter. The higher the pressure in the pump chamber 60 and beyond the pressure relief valve 82, the more the valve lip 84*b* is urged against the counter face 84*a*.

Functioning of the dispenser according to FIG. 1*a* is elucidated by means of FIGS. 1*b* and 1*c*. If the actuation handle 40, proceeding from the state of FIG. 1*a*, is pushed downward in the direction of the arrow 2*a*, this is necessarily accompanied by a deformation of the pump chamber component 50. However, the pump chamber component 50 is initially deformed only to a minor extent, since the upper end of the component 50, beyond the upper retaining portion 51*a*, while an encircling sprung region 53 on the inside of the upper retaining portion 51*a* is being elastically deformed upward in relation to the actuation handle 40, may plunge deeper into the latter.

Here, a corresponding relative movement between the valve lip 84*b* and the counter face 84*a* to the state of FIG. 1*b* also takes place. The sealing lip 84*b* is pushed onto an opening region 84*c* on the sides of the actuation handle 40, which adjoins the counter face 84*b*. An incline 84*d*, which is set in relation to the direction of the arrow 2*a* and which is interrupted multiple times and is not provided to be fully encircling but has an interruption 84*e* on the left side (in terms of the illustrations), is provided in this opening region 84*c*.

The incline 84*d* and the interruption 84*e* ensure that it is no longer possible for the valve lip 84*a* to bear in an encircling tight manner. The valve lip 84*a* lies at least in the region of the interruption 84*e* separated from the actuation handle 40. The switch valve 84*a* is now opened such that pressurized medium may now exit from the pump chamber 60 along the path 8.

If the movement of the actuation handle 40 is continued, significant deformation of the pump chamber component 50 subsequently arises. Here, the upper cylindrical region 52*a*, while being subjected to increased elastic flexural and tensile deformation in particular in the connection region 52*c*, is pushed over the lower cylindrical region 52*b*. The internal capacity of the pump chamber is reduced here such that pressurized medium therein is discharged along the path 8.

If the actuation handle 40, after the discharging procedure has been completed, is retuned back to the initial position of FIG. 1*a*, the pressure relief valve 82 is immediately closed such that negative pressure which is suitable for suctioning fresh medium from the liquids reservoir 12 is created in the pump chamber 60. The spring force by way of the sprung region 53 ensures that the sealing lip 84*b* of the switch valve 84 is also displaced back such that said sealing lip 84*b* at the end of the return stroke again bears in a sealing manner on the counter face 84*a* thereof.

Figure 2B:
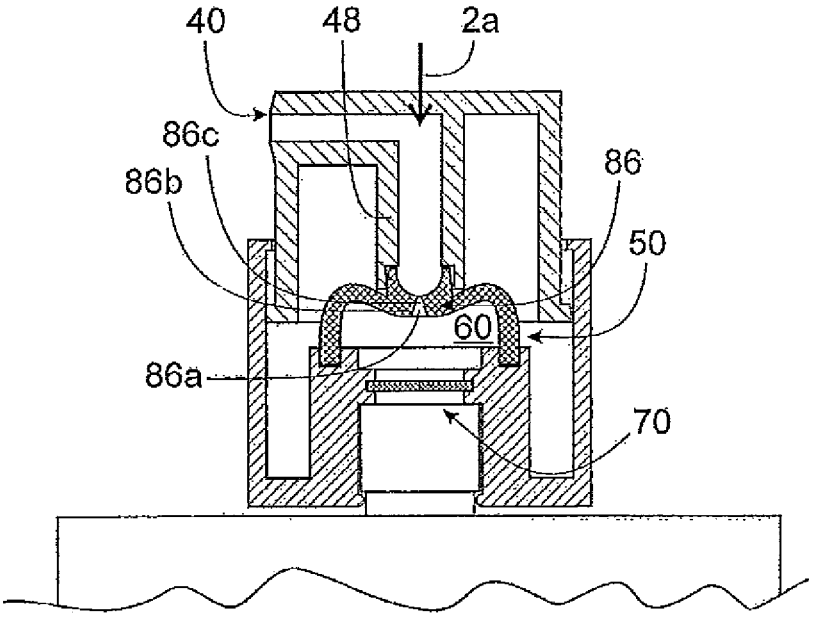

FIGS. 2*a* and 2*b* show a second design embodiment of a dispenser according to the invention. This dispenser, like the dispenser of FIGS. 1*a* to 1*c*, has a base 30 and an actuation handle 40 which, in relation to said base 30, is displaceable in the direction of an arrow 2. A deformable pump chamber component 50 which surrounds a pump chamber 60 is again provided therebetween. An inlet valve 70 which in terms of the design embodiment thereof has no role relevant to the invention and is thus illustrated in a very schematic manner is also provided at the entry side of this pump chamber. This inlet valve 70 is also opened when the pressure in the liquids reservoir 12 is greater than the pressure in the pump chamber 60. If there is thus negative pressure in the pump chamber 60, liquid is suctioned from the liquids reservoir 12.

The pump chamber wall 50 in the case of the design embodiment of FIGS. 2*a* and 2*b* is designed in a bell-type manner, this being understood to mean that also that wall of the pump chamber that points upward is formed by the pump chamber component 50 and the wall shape is mainly convex. At the upper end of the rather thick-walled pump chamber component 50, the latter is provided with a slot 86*a* which mutually separates two valve lips 86*b*, 86*c* on either side of the slot 86*a*. This slot 86*a* forms a switch valve 86 which acts as an outlet valve.

In order to cause a discharging procedure, the actuation handle 40 is moved downward in the direction of the arrow 2*a*. By way of an opening portion 48 which is an integral part of the actuation handle 40, pressure is exerted from above onto the pump chamber wall body 50 which is configured in a comparatively thick-walled manner.

As can be seen by means of FIG. 2*b*, depressing in this manner not only causes deformation of the pump chamber wall body 50 but at the same time forces the switch valve 86 to open. Even when no pressure increase at all in the pump chamber 60 is caused, the switch valve 86 is nevertheless opened since deformation of the pump chamber wall body 50 in the case of a closed switch valve 86 would require a higher contribution in terms of deformation energy, such that opening of the switch valve is a quasi-energetic result.

Figure 3A:
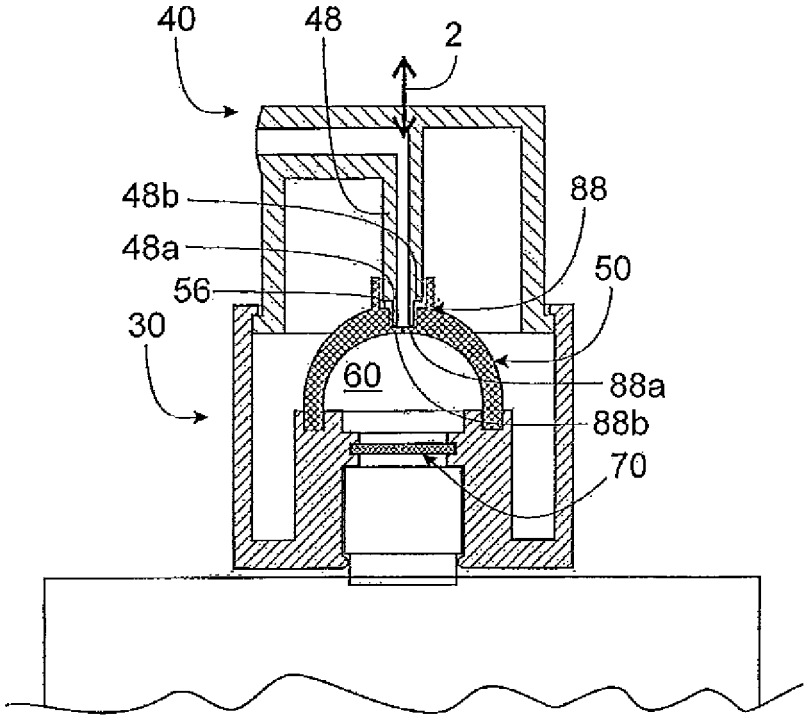
FIGS. 3*a* to 3*c* show a third exemplary embodiment of a dispenser according to the invention, in the non-actuated, the partially actuated, and the actuated state.
Figure 3B:
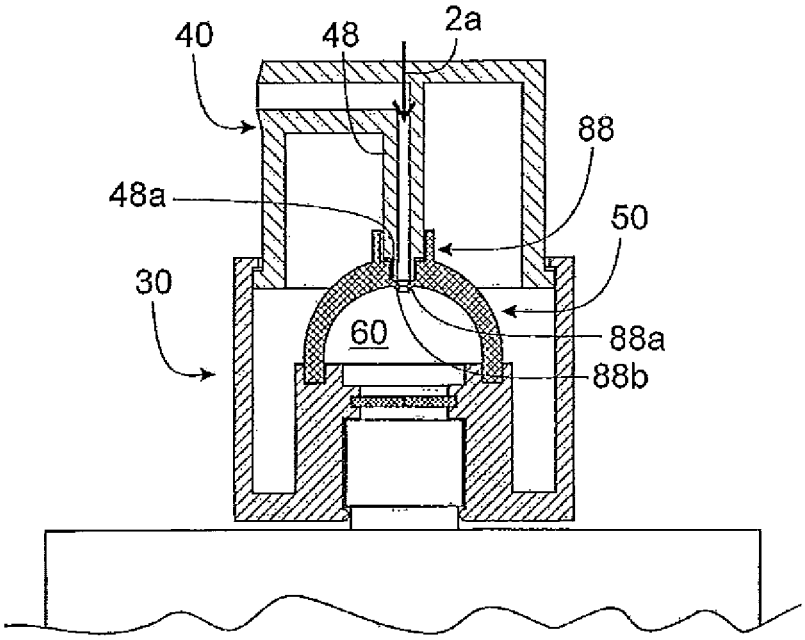
Figure 3C:
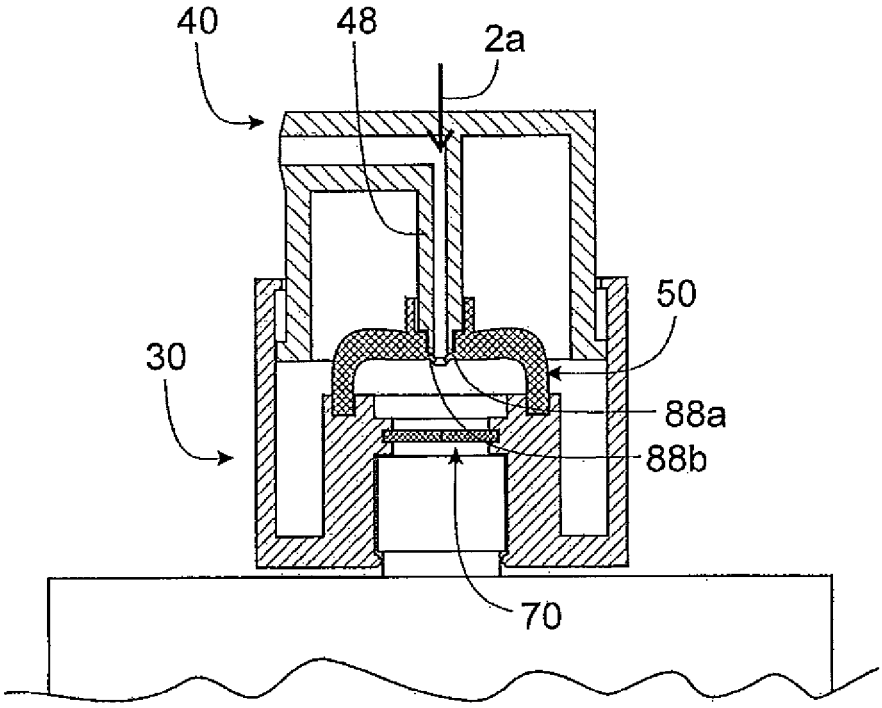

The design embodiment of FIGS. 3*a* to 3*c* is similar to that of FIGS. 2*a* and 2*b*. However, deviating from the latter it is provided that the opening portion 48 has two dissimilar active faces 48*a*, 48*b* which in relation to the actuation direction 2 are mutually offset. The pump chamber wall body 50, which in the case of this design embodiment is also designed in a bell-type manner, in the region of an outlet valve 88 has a depression. The outlet valve 88 per se disposes of two valve flaps 88*a*, 88*b*, this to be understood as being exemplary. A similar effect could also be achieved using only one valve flap 88 of a larger type.

As can be derived from FIG. 3*a*, the active face 48*a* of the opening portion 48 in the rest state bears on counter faces which are provided on the upper side of the valve flaps 88*a*, 88*b*. However, at this point in time the active face 48*b* does not yet bear on the dedicated counter face 56 thereof of the pump chamber wall body 50.

If the actuation handle 40 is now displaced downward in the direction of the arrow 2*a*, there is initially no contact between the active face 48*b* and the counter face 56. Instead, only the active face 48*a* initially acts on the valve flaps 88*a*, 88*b*, on account of which the outlet valve 88 is forcibly opened. This state is shown in FIG. 3*b*.

It is only once this has taken place that the active face 48*b* comes to bear on the pump chamber component 50. Continued displacement of the actuation handle 40 thus now leads to deformation of the pump chamber wall body 50, in the case of the outlet valve 88 being opened, said pump chamber wall body 50 here being elastically deformed such that the latter can later make available a restoring force. The internal capacity of the pump chamber 60 is reduced in the course of this deformation and any liquid being already contained in the former is discharged.

The invention claimed is:

1. A liquids dispenser for discharging pharmaceutical or cosmetic liquids, or liquids of the foodstuff sector, the dispenser comprising:

a liquids reservoir in which liquid is stored prior to discharging;

an outlet duct through which the liquid may be dispensed to an environment;

a pump chamber which, proceeding from an initial state having a maximum pump chamber capacity, is volumetrically reducible by manual actuation of an actuation handle;

an inlet valve assembly between the liquids reservoir and the pump chamber, the inlet valve assembly is opened in a pressure-controlled manner when there is negative pressure in the pump chamber in relation to the liquids reservoir; and an outlet valve assembly between the pump chamber and a discharge opening;

wherein the outlet valve assembly comprises a switch valve which, independently of liquid pressure in the pump chamber, is forcibly opened in a mechanical manner as a reaction to the actuation handle being displaced;

wherein the outlet valve assembly has a pressure relief valve which is opened in a pressure-controlled manner when there is positive pressure in the pump chamber in relation to the outlet duct;

wherein the switch valve cannot be opened solely by pressure from the pump chamber;

wherein the pump chamber has a flexible wall which enables volumetric variability of the pump chamber; and wherein the flexible wall of the pump chamber is configured so as to be closed in an encircling manner and has at one first end a substantially cylindrical first portion of an external diameter which is smaller than an internal diameter of a substantially cylindrical second portion at an opposite second end; and the flexible wall of the pump chamber in an actuated state of the actuation handle is deformed in such a manner that the first portion is surrounded by the second portion.

2. The liquids dispenser as claimed in claim 1, wherein the outlet valve assembly is configured in such a manner that the outlet valve assembly prevents opening in relation to the outlet duct when the actuation handle is not being actuated at least up to positive pressure in the pump chamber of 700 mbar.

3. The liquids dispenser as claimed in claim 2, wherein the switch valve has a first sealing face which is forcibly coupled to the actuation handle or is provided thereon, and a second sealing face which is movable in relation to the first sealing face and in a closed state of the outlet valve assembly bears on the first sealing face, wherein by displacing the actuation handle the second sealing face is traversed onto an opening region which is contiguous to the first sealing face and which is configured such that said opening region prevents the second sealing face bearing thereon in a tight manner.

4. The liquids dispenser as claimed in claim 3, wherein the component on which the first sealing face is provided, and the component on which the second sealing face is provided, are interconnected by a spring element which is tensioned when the second sealing face is transferred into the opening region.

5. The liquids dispenser as claimed in claim 3, wherein at least the second sealing face of the switch valve and at least one sealing face of the pressure relief valve are integrally configured.

6. A liquids dispenser for discharging pharmaceutical or cosmetic liquids, or liquids of the foodstuff sector, the dispenser comprising:

a liquids reservoir in which liquid is stored prior to discharging;

an outlet duct through which the liquid may be dispensed to an environment;

a pump chamber which, proceeding from an initial state having a maximum pump chamber capacity, is volumetrically reducible by manual actuation of an actuation handle;

an inlet valve assembly between the liquids reservoir and the pump chamber, the inlet valve assembly is opened in a pressure-controlled manner when there is negative pressure in the pump chamber in relation to the liquids reservoir; and an outlet valve assembly between the pump chamber and a discharge opening;

wherein the outlet valve assembly comprises a switch valve which, independently of liquid pressure in the pump chamber, is forcibly opened in a mechanical manner as a reaction to the actuation handle being displaced;

wherein the outlet valve assembly has a pressure relief valve which is opened in a pressure-controlled manner when there is positive pressure in the pump chamber in relation to the outlet duct;

wherein the switch valve cannot be opened solely by pressure from the pump chamber; and wherein an opening portion which is displaceable by the actuation handle and has two active faces is provided, wherein a first active face of the two active faces is provided for impinging a first counter face on a valve body or on a valve flap with a force; wherein a second active face of the two active faces is provided for impinging a second counter face with a force, wherein the pump chamber is reducible in size by impinging the second counter face with a force; and in an initial state of the liquids dispenser, in which the actuation handle is not actuated, the spacing between the first active face and the first counter face is smaller than the spacing between the second active face and the second counter face.

7. The liquids dispenser as claimed in claim 6, wherein the pump chamber has in a region of the elastically deformable wall a shape which is formed by the deformable wall and which tapers off in a direction of the switch valve.

8. The liquids dispenser as claimed in claim 1, wherein the liquids dispenser is configured as a collapsible liquids dispenser.

9. The liquids dispenser as claimed in claim 1, wherein a sealing face of the pressure relief valve is integrally connected to the wall.

10. The liquids dispenser as claimed in claim 7, wherein the shape is a bell shape.

11. The liquids dispenser as claimed in claim 8, wherein the collapsible liquids dispenser comprises a tube.

* * * * *